US010428507B2

(12) United States Patent
Hashimoto et al.

(10) Patent No.: US 10,428,507 B2
(45) Date of Patent: Oct. 1, 2019

(54) FLUSH TOILET

(71) Applicant: TOTO LTD., Kitakyushu-shi, Fukuoka (JP)

(72) Inventors: Hiroshi Hashimoto, Fukuoka (JP); Shinichi Urata, Fukuoka (JP); Shuichi Nagashima, Fukuoka (JP); Mayu Okubo, Fukuoka (JP); Shoko Imaizumi, Fukuoka (JP); Daisuke Yamamoto, Fukuoka (JP); Kenichi Nakamura, Fukuoka (JP); Takumi Tsuchitani, Fukuoka (JP)

(73) Assignee: TOTO LTD., Kitakyushu-Shi (JP)

( * ) Notice: Subject to any disclaimer, the term of this patent is extended or adjusted under 35 U.S.C. 154(b) by 3 days.

(21) Appl. No.: 15/861,795

(22) Filed: Jan. 4, 2018

(65) Prior Publication Data

US 2018/0195261 A1 Jul. 12, 2018

(30) Foreign Application Priority Data

Jan. 12, 2017 (JP) ..... 2017-003598

(51) Int. Cl.
*E03D 11/08* (2006.01)

(52) U.S. Cl.
CPC ..... *E03D 11/08* (2013.01)

(58) Field of Classification Search
CPC ..... E03D 11/08
USPC ..... 4/420
See application file for complete search history.

(56) References Cited

U.S. PATENT DOCUMENTS

2018/0195262 A1* 7/2018 Hashimoto ..... E03D 11/08

* cited by examiner

*Primary Examiner* — Lori L Baker
(74) *Attorney, Agent, or Firm* — Amin, Turocy & Watson LLP

(57) ABSTRACT

A flush toilet according to an embodiment includes a main water guide channel, a bending water guide channel, a rim water guide channel, and a retention part. The bending water guide channel bends a flow direction of washing water supplied from the main water guide channel. The rim water guide channel causes the washing water to flow toward and to be spouted from a water spout part. The retention part is formed in at least the bending water guide channel. An upper part of the retention part is formed into an opened concave shape and the retention part retains a part of the washing water. Furthermore, the retention part is formed in such a manner that an upper end thereof on a downstream side is horizontal to a bottom surface of the water spout part or higher than the bottom surface of the water spout part.

7 Claims, 4 Drawing Sheets

FLUSH TOILET

CROSS-REFERENCE TO RELATED APPLICATION

This application is based upon and claims the benefit of priority of the prior Japanese Patent Application No. 2017-003598, filed on Jan. 12, 2017, the entire contents of which are incorporated by reference.

FIELD

An embodiment of the disclosure relates to a flush toilet.

BACKGROUND

A flush toilet has conventionally been known that spouts washing water from a rim part that is formed on an upper edge of a bowl part of a toilet body to generate a swirling flow on the bowl part and thereby execute washing of the bowl part (see, for example, Japanese Laid-open Patent Publication No. 2016-142100).

Specifically, in a flush toilet, washing water is first supplied from a water supply source such as a water storage tank to a main water guide channel that is formed below the water storage tank. Then, washing water that is supplied to a main water guide channel flows into a rim water guide channel that is formed along a rim part, then passes through the rim water guide channel, and is spouted from a water spout part that is opened toward a bowl part.

However, at a time when washing water on a main water guide channel as described above flows into a rim water guide channel, flowing thereto is executed, for example, after colliding with a wall surface of the rim water guide channel, so that air may be involved due to such collision. In particular, water saving for a toilet progresses in recent years and a small amount of washing water has to be run powerfully in order to execute washing efficiently, so that collision thereof with high energy may involve air at an increased pressure. When washing water that has involved air is spouted from a water spout part, such air may blow up to scatter such washing water. Furthermore, high impact thereof may cause flow turbulence to enhance scattering from a water spout part. Thus, there is room for improvement in a flush toilet according to a conventional technique in that scattering of washing water that is spouted from a water spout part is suppressed.

SUMMARY

A flush toilet according to an embodiment includes a main water guide channel, a bending water guide channel, a rim water guide channel, and a retention part. The main water guide channel causes washing water supplied from a water supply source to flow therethrough. The bending water guide channel bends a flow direction of the washing water supplied from the main water guide channel. The rim water guide channel causes the washing water supplied from the bending water guide channel to flow toward and to be spouted from a water spout part that is opened toward a bowl part. The retention part is formed in at least the bending water guide channel. An upper part of the retention part is formed into an opened concave shape and the retention part retains a part of the washing water supplied from the main water guide channel. Furthermore, the retention part is formed in such a manner that an upper end thereof on a downstream side is horizontal to a bottom surface of the water spout part or higher than the bottom surface of the water spout part.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENT

Hereinafter, an embodiment of a flush toilet as disclosed in the present application will be described in detail with reference to the accompanying drawings. Additionally, this invention is not limited by an embodiment as described below.

1. Configuration of Flush Toilet

Figure 1:
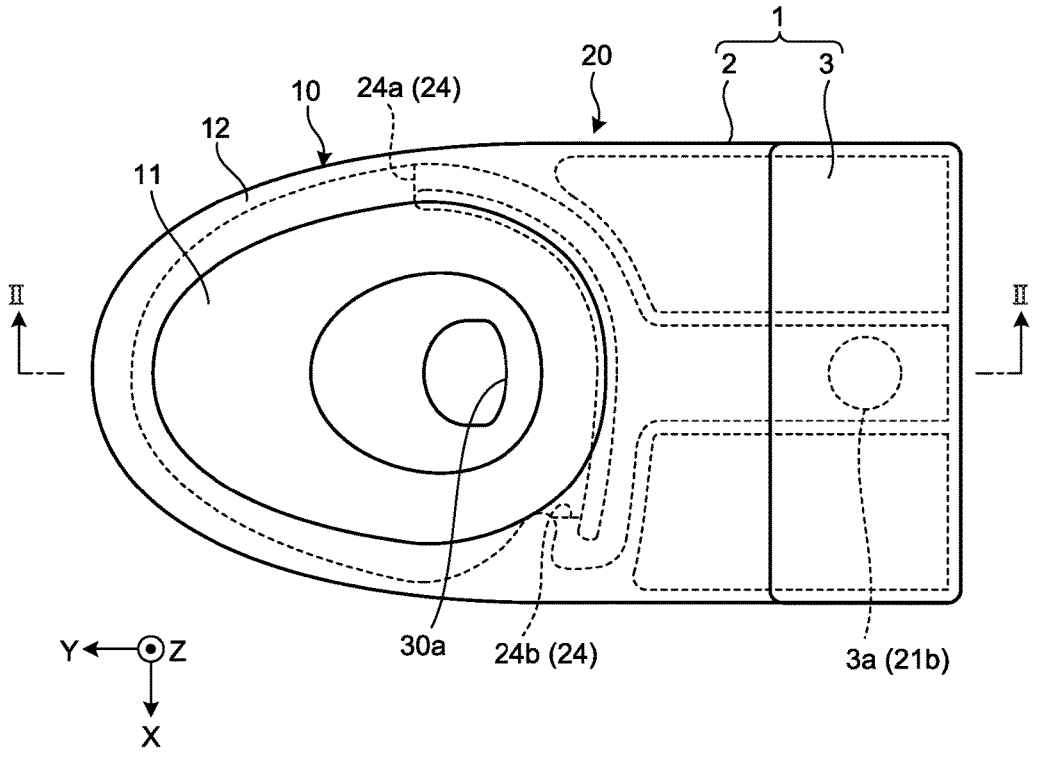
FIG. 1 is a plan view illustrating a flush toilet according to an embodiment.
Figure 2:
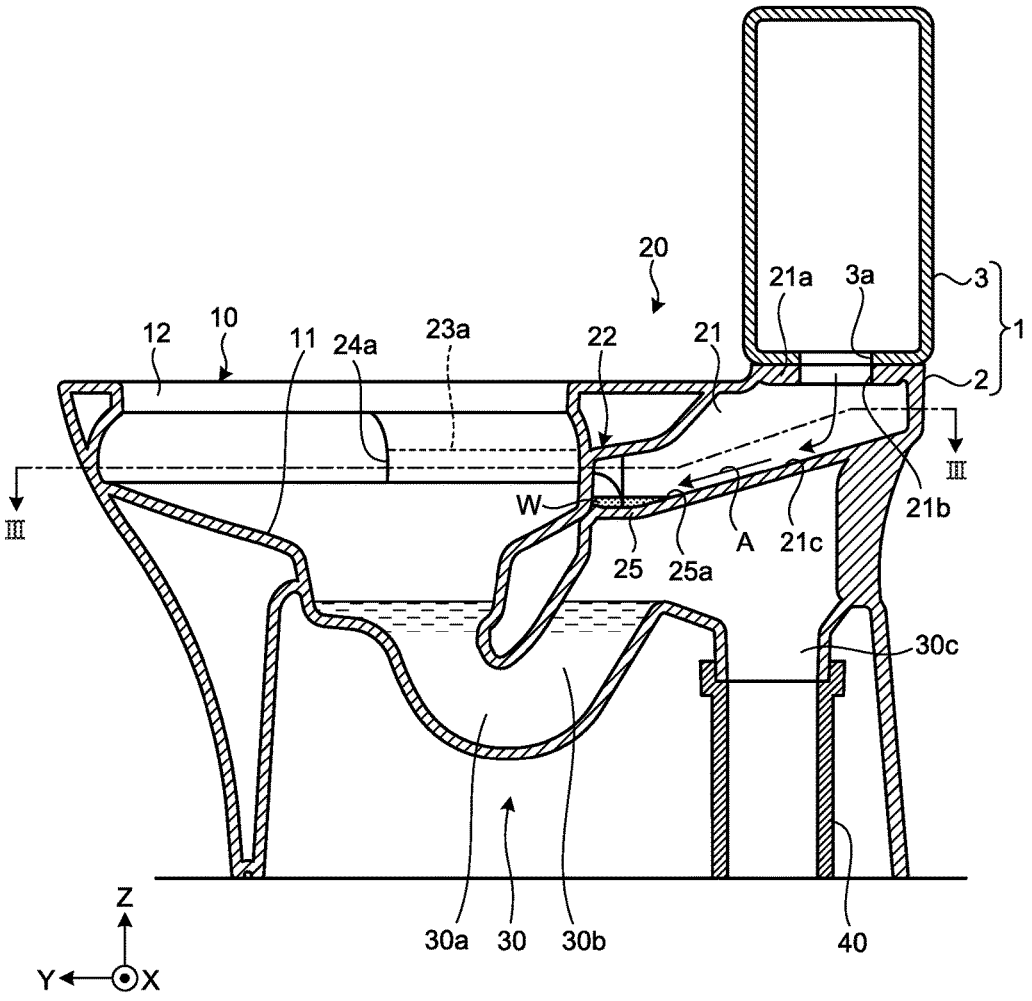
FIG. 2 is a cross-sectional view along line II-II of FIG. 1.

FIG. 1 is a plan view illustrating a flush toilet according to an embodiment and FIG. 2 is a cross-sectional view along line II-II of FIG. 1. Additionally, FIG. 1 or the like illustrates a three-dimensional orthogonal coordinate system that includes a Z-axis with a vertically upward direction being a positive direction thereof, for readily understanding an explanation(s). Such an orthogonal coordinate system may also be illustrated in another diagram.

Figure 3:
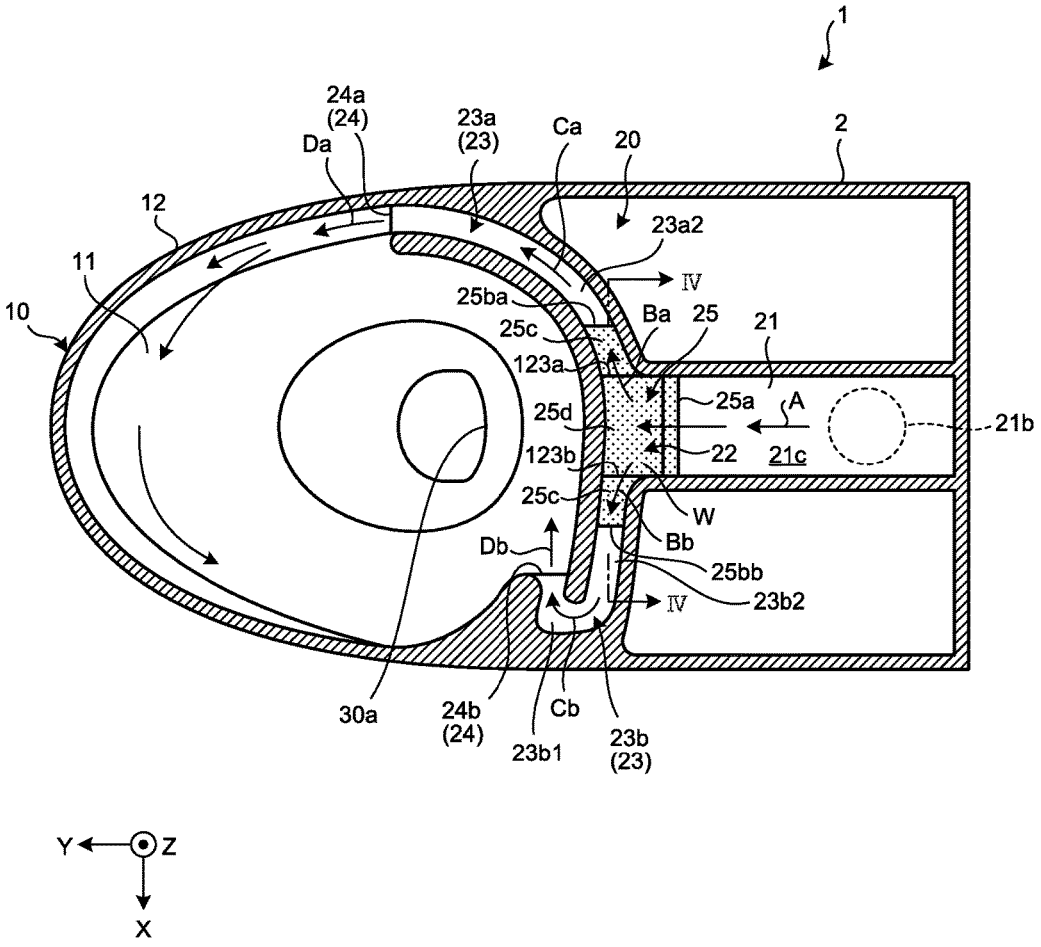
FIG. 3 is a cross-sectional view along line III-III of FIG. 2.

Furthermore, in the following description(s), a positive direction of an X-axis, a negative direction of the X-axis, a positive direction of a Y-axis, a negative direction of the Y-axis, a positive direction of a Z-axis, and a negative direction of the Z-axis in an orthogonal coordinate system may be described as a "rightward direction", a "leftward direction", a "forward direction", a "backward direction", an "upward direction", and a "downward direction", respectively. Additionally, any diagram that is provided subsequent to FIGS. 1, 2, and 3 is a schematic diagram.

As illustrated in FIG. 1 and FIG. 2, a flush toilet 1 is made of, for example, a ceramic and includes a toilet body 2 and a water storage tank 3.

The water storage tank 3 is placed on a back and upper part of the toilet body 2. The water storage tank 3 stores washing water that washes a bowl part 10 (as described later) of the toilet body 2. As illustrated in FIG. 2, an opening 3*a* that penetrates through a bottom surface of the water storage tank 3 in upward and downward directions is provided on the bottom surface. A non-illustrated on-off valve is installed at the opening 3*a*, and as a (non-illustrated) operation part for starting washing of a toilet is operated, opening is executed for the opening 3*a* to drain washing water. Additionally, although the water storage tank 3 is an example of a water supply source, this is not limiting and a flush valve may be used as a water supply source.

The toilet body 2 includes a bowl part 10, a water guide channel 20, and a drainage water trap part 30 (see FIG. 2). Additionally, FIG. 1 or 2 omits illustration of some members such as a toilet seat that is included in the toilet body 2 or a cover that covers such a toilet seat for simplification of illustration.

The bowl part 10 includes a waste receiving surface 11 and a rim part 12. The waste receiving surface 11 is formed into a bowl shape capable of receiving waste. The rim part 12 is formed so as to compose an upper edge of the bowl part 10.

Furthermore, a first water spout part 24*a* and a second water spout part 24*b* to spout washing water in a case where washing of a toilet is executed are formed on the rim part 12. The first water spout part 24*a* is formed, for example, near a center of a left side of the rim part 12. The second water spout part 24*b* is formed, for example, on a right back side of the rim part 12.

Furthermore, both of the first and second water spout parts 24*a* and 24*b* are opened in an orientation for generating, for example, a counterclockwise swirling flow (see FIG. 3) on the waste receiving surface 11 when washing water is spouted to the waste receiving surface 11 of the bowl part 10. Additionally, a position where the first or second water spout part 24*a* or 24*b* as described above is formed or an orientation of an opening thereof is merely illustrative and not limiting. Furthermore, the first water spout part 24*a* or the second water spout part 14*b* may be described as a "water spout part 24" when not being distinguished from one another below.

The water guide channel 20 is a flow channel that guides washing water in the water storage tank 3 to the bowl part 10. Additionally, a detailed configuration of the water guide channel 20 will be described later.

As illustrated in FIG. 2, the drainage water trap part 30 includes an inlet part 30*a*, a rise pipeline 30*b*, and a fall pipeline 30*c*. The inlet part 30*a* is provided so as to be continuous with a bottom part of the waste receiving surface 11 and causes washing water from the bowl part 10 to flow into the drainage water trap part 30. The rise pipeline 30*b* is formed so as to extend obliquely upward from the inlet part 30*a*. The fall pipeline 30*c* is formed so as to extend downward from the rise pipeline 30*b*.

Furthermore, a water drainage pipe 40 is connected to a lower end of the fail pipeline 30*c*. Therefore, in a case where washing of a toilet is executed, washing water in the bowl part 10 is drained to the water drainage pipe 40 through the inlet part 30*a*, the rise pipeline 30*b*, and the fall pipeline 30*c* of the drainage water trap part 30.

Additionally, the flush toilet 1 is a so-called wash-out type that washes away waste due to an action of running water that is provided by a drop of washing water in the bowl part 10. Furthermore, the flush toilet 1 is not limited to a wash-out type but may be, for example, a so-called siphon type that drains water while waste in the bowl part 10 is drawn by utilizing a siphon action. Additionally, although FIG. 1 or 2 illustrates the flush toilet 1 of a floor-mounted type, this is not limiting and a wall-hung type may be provided.

Thus, the flush toilet 1 according to the present embodiment spouts washing water from the water spout part 24 that is provided on the rim part 12, and generates a swirling flow on the waste receiving surface 11 of the bowl part 10 to execute washing of the bowl part 10.

2. Configuration of Water Guide Channel

Next, the water guide channel 20 as described above will be described in detail with reference to FIG. 2 and FIG. 3. FIG. 3 is a cross-sectional view along line III-III of FIG. 2.

The water guide channel 20 is a flow channel for washing water and is configured to be capable of suppressing scattering at a time when washing water is spouted from the water spout part 24. Specifically, the water guide channel 20 includes a main water guide channel 21, a bending water guide channel 22, a rim water guide channel 23, and a retention part 25.

As illustrated in FIG. 2, the main water guide channel 21 is formed from a lower part of the water storage tank 3 toward a front part of a toilet and causes washing water supplied from the water storage tank 3 to flow therethrough (see arrow A). In detail, an inflow port 21*b* that penetrates through a back part ceiling surface 21*a* of the main water guide channel 21 in upward and downward directions is formed on the back part ceiling surface 21*a* at a position that corresponds to the opening 3*a* of the water storage tank 3. The inflow port 21*b* causes washing water in the water storage tank 3 to flow into the main water guide channel 21 as opening is executed for the opening 3*a* by an on-off valve of the water storage tank 3 as described above.

Furthermore, the main water guide channel 21 is formed in such a manner that a bottom surface 21*c* thereof slopes downward from an upstream side toward a downstream side. A flow rate or flow volume of washing water that flows through the main water guide channel 21 tends to decrease with water saving in recent years, but the main water guide channel 21 slopes downward so that it is possible to increase a flow rate of washing water that flows from the inflow port 21*b* into and flows through the main water guide channel 21, and hence, it is possible to improve a washing performance of the flush toilet 1. That is, it is possible for washing water with a flow rate that is increased on the main water guide channel 21 to form a swirling flow so as to be sufficiently distributed all over the waste receiving surface 11 when water is spouted from the water spout part 24 that is provided on a wake flow side of the main water guide channel 21. Thereby, it is possible to wash the waste receiving surface 11 efficiently, and hence, it is possible to improve a washing performance of the flush toilet 1.

The bending water guide channel 22 is formed so as to be continuous with a downstream side of the main water guide channel 21 and bends a flow direction of washing water that is supplied from the main water guide channel 21 as illustrated in FIG. 3.

In detail, the bending water guide channel 22 bends a flow of washing water that is supplied from the main water guide channel 21 (a positive direction of a Y-axis in a plan view of FIG. 3) toward, for example, two or left and right directions (a positive direction of an X-axis and a negative direction of the X-axis in a plan view of FIG. 3) as indicated by arrows Ba and Bb in FIG. 3.

Thus, the bending water guide channel 22 bends a flow of washing water that is supplied from the main water guide channel 21 toward a plurality of different directions (herein, left and right directions). In other words, the bending water guide channel 22 is a branch channel that branches a flow channel of washing water that is supplied from the main water guide channel 21 into left and right directions. Additionally, although the bending water guide channel 22 bends a flow of washing water toward two or left and right directions in the above description(s), three or more directions are allowed. Furthermore, the retention part 25 is formed in the bending water guide channel 22, where this will be described later.

The rim water guide channel 23 is formed so as to continuous with a downstream side of the bending water guide channel 22 and causes washing water that is supplied from the bending water guide channel 22 to flow toward and to be spouted from the water spout part 24. In detail, the rim water guide channel 23 includes a first rim water guide channel 23*a* and a second rim water guide channel 23*b* as well as the first and second water spout parts 24*a* and 24*b* as described above.

The first rim water guide channel 23*a* is formed along the rim part 12 from a back side to a left side of the bowl part 10. Furthermore, the first water spout part 24*a* is formed at an end of the first rim water guide channel 23*a* on a downstream side.

Washing water with a flow direction that is bent toward a left side of the bowl part 10 by the bending water guide channel 22 flows into the first rim water guide channel 23*a*, then flows counterclockwise in a plan view (see arrow Ca), and subsequently, is spouted from the first water spout part 24*a* to the waste receiving surface 11 of the bowl part 10 (see arrow Da).

The second rim water guide channel 23*b* is formed along the rim part 12 on a back side of the bowl part 10. Furthermore, the second rim water guide channel 23*b* includes a bending site 23*b*1 that bends a flow direction of washing water in the middle of such a flow channel. Specifically, the bending site 23*b*1 of the second rim water guide channel 23*b* bends a flow direction of washing water clockwise in a plan view to flow in a circumferential direction of the bowl part 10, more specifically, causes such washing water to make a U-turn and be directed to a back side of the bowl part 10. Furthermore, the second water spout part 24*b* is formed on an end of the second rim water guide channel 23*b* on a downstream side.

Thereby, washing water with a flow direction that is bent toward a right side of the bowl part 10 by the bending water guide channel 22 flows into the second rim water guide channel 23*b* and flows clockwise in a plan view, and subsequently, a flow direction thereof is reversed by the bending site 23*b*1 to be counterclockwise (see arrow Cb). Subsequently, washing water is spouted from the second water spout part 24*b* to the waste receiving surface 11 of the bowl part 10 (see arrow Db).

Thus, the second rim water guide channel 23*b* bends a flow direction of washing water that is supplied from the bending water guide channel 22 to spout such water from the second water spout part 24*b* to a back side of the bowl part 10.

Additionally, in the present specification, the first water spout part 24*a* as described above refers to a boundary part between a space that is closed by the first rim water guide channel 23*a* and a space that is opened on a downstream side thereof, and further, the second water spout part 24*b* refers to a boundary part between a space that is closed by the second rim water guide channel 23*b* and a space that is opened on a downstream side thereof. Furthermore, in the present specification, the main water guide channel 21 refers to the inflow port 21*b* to an upper end 25*a* on aback side of the retention part 25 as described later. The bending water guide channel 22 refers to the upper end 25*a* on a back side of the retention part 25 to each of inlet parts 123*a* and 123*b* of the first and second rim water guide channels 23*a* and 23*b* (in other words, a position where a flow of washing water that flows toward a front part of a toilet bends toward a circumferential direction of the bowl part 10). Furthermore, the first and second rim water guide channels 23*a* and 23*b* refer to the inlet parts 123*a* and 123*b* to the first and second water spout parts 24*a* and 24*b*, respectively.

Meanwhile, in a case where washing water flows from the main water guide channel 21 to the first and second rim water guide channels 23*a* and 23*b* through the bending water guide channel 22 as described above, washing water on the main water guide channel 21 collides with a wall surface of the bending water guide channel 22, the first or second ram water guide channel 23*a* or 23*b*, or the like and readily involves air at a pressure that is increased by such collision. As washing water involves air, such air may blow up and scatter peripherally, for example, at a time when water is spouted from the water spout part 24.

Figure 4:
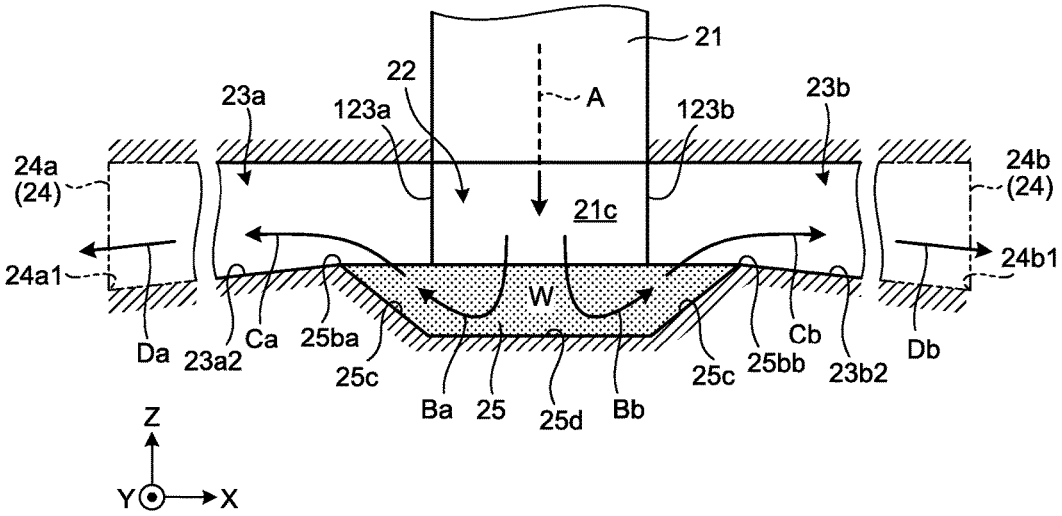
FIG. 4 is a cross-sectional view along line IV-IV of FIG. 3.

Hence, in the present embodiment, the retention part 25 is formed in the bending water guide channel 22 to suppress scattering of washing water as described above. Hereinafter, the retention part 25 will be described in detail with reference to FIG. 2 to FIG. 4. FIG. 4 is a cross-sectional view along line IV-IV of FIG. 3.

As illustrated in FIG. 2 to FIG. 4, the retention part 25 is formed below the bending water guide channel 22 and retains a part of washing water that is supplied from the main water guide channel 21. Washing water that is retained in the retention part 25 may be described as "retained water W" below. Additionally, retained water W is indicated by dots in FIG. 2 to FIG. 4.

Specifically, an opened upper part of the retention part 25 is formed into, for example, an opened concave shape and the retention part 25 is connected to the bottom surface 21*c* of the main water guide channel 21 on an upper end side thereof and bottom surfaces 23*a*2 and 23*b*2 of the first and second rim water guide channels 23*a* and 23*b*. In detail, the upper end 25*a* on a back part (see FIG. 2), an upper end 25*ba* on a left part (see FIG. 4), and an upper end 25*bb* on a right part (see FIG. 4) of the retention part 25 are connected to the bottom surface 21*c* of the main water guide channel 21, the bottom surface 23*a*2 of the first rim water guide channel 23*a*, and the bottom surface 23*b*2 of the second rim water guide channel 23*b*, respectively. Therefore, the upper end 25*a* is provided on an upstream side and the upper ends 25*ba* and 25*bb* are provided on downstream sides, in flow directions of washing water.

As illustrated in FIG. 4, the retention part 25 is formed in such a manner that the upper end 25*ba* on a downstream side is higher than a bottom surface 24*a*1 of the first water spout part 24*a* and formed in such a manner that the upper end 25*bb* on a downstream side is higher than a bottom surface 24*b*1 of the second water spout part 24*b*. In other words, both the upper ends 25*ba* and 25*bb* of the retention part 25 and the bottom surfaces 24*a*1 and 24*b*1 of the first and second water spout parts 24*a* and 24*b* are formed so as to slope downward. Additionally, in FIG. 4, the bottom surfaces 24*a*1 and 24*b*1 of the first and second water spout parts 24*a* and 24*b* are indicated by imaginary lines for readily understanding a height relationship between the upper ends 25*ba* and 25*bb* of the retention part 25 and the bottom surfaces 24*a*1 and 24*b*1 of the first and second water spout parts 24*a* and 24*b*.

Therefore, a state is provided where retained water W is retained only in the retention part 25 on the water guide channel 20 before washing of a toilet. That is, washing water flows through the first and second rim water guide channels 23*a* and 23*b* and is spouted from the first and second water spout parts 24*a* and 24*b*, for example, due to washing of a toilet. Then, even in a case where washing water remains on the first and second rim water guide channels 23*a* and 23*b*, for example, after completion of washing of a toilet, remaining washing water flows toward the first and second water spout parts 24*a* and 24*b* and is drained to the bowl part 10, due to a height relationship as described above.

Hence, a state where retained water W is retained only in the retention part 25 whereas washing water is not retained on the first rim water guide channel 23*a* or the second rim water guide channel 23*b* is provided on the water guide channel 20 after completion of washing of a toilet and before next washing of a toilet.

Additionally, a height relationship between the upper ends 25*ba* and 25*bb* and the bottom surfaces 24*a*1 and 24*b*1 is not limited to that described above, and the upper ends 25*ba* and 25*bb* of the retention part 25 may be formed, for example, so as to be horizontal or substantially horizontal to the bottom surfaces 24*a*1 and 24*b*1 of the first and second water spout parts 24*a* and 24*b*.

As described above, retained water W is present in the retention part 25 so that washing water does not readily involve air at a time of washing of a toilet and it is possible to suppress scattering of washing water that is spouted from the water spout part 24. In detail, as washing water is supplied to the main water guide channel 21 at a time of washing of a toilet, such washing water on the main water guide channel 21 flows into and collides with the retention part 25.

Herein, washing water collides with retained water W in the retention part 25 as indicated by arrows Ba and Bb in FIG. 4. Hence, as compared with a case where washing water directly collides with, for example, a wall surface of the bending water guide channel 22 or the like, impact force thereof is relieved by retained water W in the retention part 25 and air at an increased pressure is not readily involved thereby. That is, the retention part 25 functions as a buffer part for washing water.

Then, washing water that comparatively does not involve air at an increased pressure also does not readily cause blowing up of air at a time of spouting of water, and further, flow turbulence is also not readily caused even after flowing out to the first rim water guide channel 23*a* or the second rim water guide channel 23*b* as indicated by arrow Ca or Cb, so that it is possible to suppress scattering at a time when water is spouted from the first or second water spout part 24*a* or 24*b*.

Furthermore, the upper ends 25*ba* and 25*bb* of the retention part 25 are formed so as to be higher than the bottom surfaces 24*a*1 and 24*b*1 of the first and second water spout parts 24*a* and 24*b* as described above, so that washing water is spouted obliquely downward from the first and second water spout parts 24*a* and 24*b* (see arrows Da and Db in FIG. 4). Thereby, it is possible to suppress scattering of washing water that is spouted from the first or second water spout part 24*a* or 24*b*, to an upper or user side.

Furthermore, the upper ends 25*ba* and 25*bb* of the retention part 25 on downstream sides are formed so as to be horizontal to the bottom surfaces 24*a*1 and 24*b*1 of the first and second water spout parts 24*a* and 24*b* or higher than the bottom surfaces 24*a*1 and 24*b*1, so that it is possible to prevent turbulence from being readily caused in a flow of washing water at a time of spouting of water. That is, for example, if washing water for water spouting at a previous time remains between the upper ends 25*ba* and 25*bb* of the retention part 25 and the bottom surfaces 24*a*1 and 24*b*1 of the first and second water spout parts 24*a* and 24*b*, washing water for water spouting at the present time readily involves remaining washing water to cause flow turbulence.

On the other hand, in the present embodiment, a height relationship between the upper ends 25*ba* and 25*bb* of the retention part 25 and the bottom surfaces 24*a*1 and 24*b*1 of the first and second water spout parts 24*a* and 24*b* is provided as described above, so that washing water does not remain between the upper ends 25*ba* and 25*bb* of the retention part 25 and the bottom surfaces 24*a*1 and 24*b*1 of the first and second water spout parts 24*a* and 24*b*, and as a result, it is possible to prevent turbulence from being readily caused in a flow of washing water at a time of water spouting.

Moreover, the retention part 25 includes a sloping surface 25*c*. The sloping surface 25*c* includes a surface that is continuous with a bottom surface 25*d* of the retention part 25 and is directed to a side of the first rim water guide channel 23*a* and a surface that is continuous with the bottom surface 25*d* and is directed to a side of the second rim water guide channel 23*b*. Then, the sloping surface 25*c* is formed so as to slope upward from the bottom surface 25*d* of the retention part 25 toward the upper end 25*ba* or 25*bb* on a downstream side.

Thereby, washing water that is supplied from the main water guide channel 21 at a time of washing of a toilet flows into the retention part 25 and is mixed with retained water W, subsequently rises along the sloping surface 25*c* gradually, and flows out to the first rim water guide channel 23*a* or the second rim water guide channel 23*b*. Thereby, it is possible to reduce a pressure loss of washing water and provide a smooth flow thereof as compared with, for example, a case where the sloping surface 25*c* of the retention part 25 is a perpendicular surface, and hence, it is possible to further prevent flow turbulence from being readily caused after flowing out to the first or second rim water guide channel 23*a* or 23*b*.

Furthermore, the second rim water guide channel 23*b* is such that a length of such a flow channel is less than that of the first rim water guide channel 23*a* and further a flow direction thereon is changed by the bending site 23*b*1 (see FIG. 3) as described above, so that water is spouted without controlling air inclusion or flow turbulence that is caused on the bending water guide channel 22, and hence, washing water that is spouted from the second water spout part 24*b* may be scattered. However, in the present embodiment, air is comparatively not involved on the second rim water guide channel 23*b* and washing water that does not readily cause flow turbulence is supplied, so that it is possible to suppress scattering at a time when water is spouted from the second water spout part 24*b*.

Furthermore, the bending water guide channel 22 bends a flow of washing water that is supplied from the main water guide channel 21 toward left and right directions as described above, so that washing water on the main water guide channel 21 may cause collision thereof and involve air. However, in the present embodiment, the retention part 25 is included, so that impact force caused by collision of washing water is relieved by retained water W in the retention part 25 and such washing water does not readily involve air. Thereby, it is possible to suppress scattering at a time when water is spouted from the first or second water spout part 24*a* or 24*b*.

Furthermore, the retention part 25 is formed in such a manner that the upper ends 25*ba* and 25*bb* on downstream sides are positioned on the first and second rim water guide channels 23*a* and 23*b*. That is, the retention part 25 is formed in such a manner that the upper ends 25*ba* and 25*bb* on downstream sides are incorporated into the first and second rim water guide channels 23*a* and 23*b*.

Thereby, it is possible to suppress greatly changing a cross-sectional area of a flow channel for washing water that flows into the first and second rim water guide channels 23*a* and 23*b* from the upper ends 25*ba* and 25*bb* of the retention part 25 on downstream sides to cause flow turbulence thereof, and as a result, it is possible to suppress scattering at a time when water is spouted from the first or second water spout part 24*a* or 24*b*.

Furthermore, the main water guide channel 21 is formed so as to slope downward as described above, so that a flow rate of washing water that flows through the main water guide channel 21 increases. Thereby, it is possible to improve a washing performance of the flush toilet 1, but washing water with an increased flow rate collides with the bending water guide channel 22 so that a larger amount of air may be involved thereby. However, in the present embodiment, the retention part 25 is included, so that even in a case where a flow rate is increased, impact force caused by collision of washing water is relieved by retained water W in the retention part 25 and such washing water does not readily involve air. Thereby, it is possible to suppress scattering at a time when water is spouted from the first or second water spout part 24*a* or 24*b*. That is, in the present embodiment, it is possible to attain both improvement of a washing performance of the flush toilet 1 and suppression of scattering of washing water.

As described above, a flush toilet according to an embodiment includes the main water guide channel 21, the bending water guide channel 22, the rim water guide channel 23, and the retention part 25. The main water guide channel 21 causes washing water supplied from the water storage tank 3 (an example of a water supply source) to flow therethrough. The bending water guide channel 22 bends a flow direction of washing water that is supplied from the main water guide channel 21. The rim water guide channel 23 causes washing water supplied from the bending water guide channel 22 to flow toward and to be spouted from the water spout part 24 that is opened toward the bowl part 10. The retention part 25 is formed in at least the bending water guide channel 22, an upper part thereof is formed into an opened concave shape, and the retention part 25 retains a part of washing water that is supplied from the main water guide channel 21. Furthermore, the retention part 25 is formed in such a manner that the upper ends 25*ba* and 25*bb* on downstream sides are horizontal to the bottom surfaces 24*a*1 and 24*b*1 of the water spout part 24 or higher than the bottom surfaces 24*a*1 and 24*b*1 of the water spout part 24. Thereby, in the present embodiment, it is possible to suppress scattering of washing water that is spouted from the water spout part 24.

3. Illustrative Variation

Figure 5:
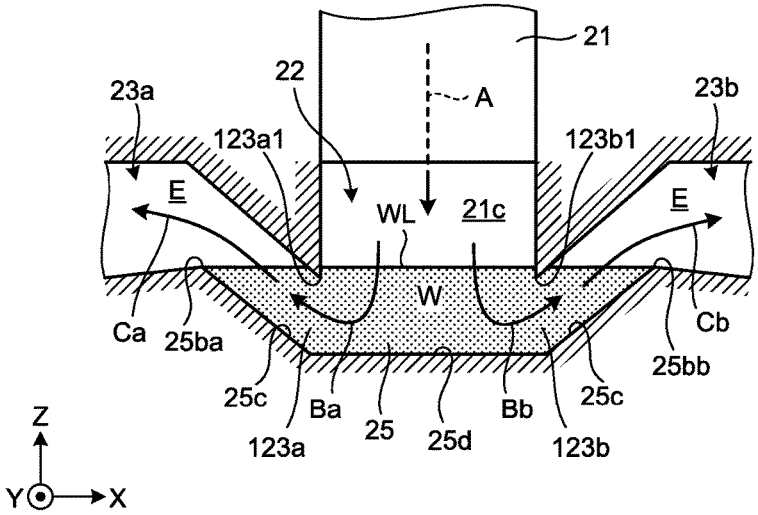
FIG. 5 is a cross-sectional view illustrating a retention part of a flush toilet according to an illustrative variation.

Next, a flush toilet 1 according to an illustrative variation will be described. FIG. 5 is a cross-sectional view similar to FIG. 4 and illustrates a retention part 25 and a rim water guide channel 23 according to the illustrative variation.

As illustrated in FIG. 5, first and second rim water guide channels 23*a* and 23*b* according to the illustrative variation are formed in such a manner that respective inlet parts 123*a* and 123*b* are positioned below a water surface WL of washing water W that retains in the retention part 25. In detail, upper ends 123*a*1 and 123*b*1 of the inlet parts 123*a* and 123*b* of the first and second rim water guide channels 23*a* and 23*b* are positioned below a water surface WL of washing water W so that the whole of the inlet parts 123*a* and 123*b* is submerged.

Therefore, in the illustrative variation, for example, washing water that flows from the retention part 25 to the first or second rim water guide channel 23*a* or 23*b* does not readily contact air, and as a result, it is possible to suppress involvement of air efficiently.

Furthermore, washing water that flows out from the retention part 25 to the first and second rim water guide channels 23*a* and 23*b* flows while pushing out, for example, air E on the first and second rim water guide channels 23*a* and 23*b* toward the water spout part 24, so that air is not readily involved, and hence, it is possible to further suppress scattering at a time when water is spouted from the water spout part 24. Moreover, it is also possible to reliably circulate washing water that is retained in a retention part, due to washing water that is supplied from a bending water guide channel.

Additionally, although the rim water guide channel 23 includes the first rim water guide channel 23*a* and the second rim water guide channel 23*b* in the embodiment as described above, this is not limiting and either only one thereof may be included.

Therefore, in a case where the rim water guide channel 23 includes only the first rim water guide channel 23*a*, the bending water guide channel 22 bends a flow of washing water that is supplied from the main water guide channel 21 toward only one direction that is a direction of the first rim water guide channel 23*a*. On the other hand, in a case where the rim water guide channel 23 includes only the second rim water guide channel 23*b*, the bending water guide channel 22 bends a flow of washing water that is supplied from the main water guide channel 21 toward only one direction that is a direction of the second rim water guide channel 23*b*. Thus, even in a case where the bending water guide channel 22 bends a flow of washing water toward only one direction, the retention part 25 is included so that it is possible to suppress scattering of washing water.

Furthermore, the sloping surface 25*c* of the retention part 25 as described above is formed on both a side of the first rim water guide channel 23*a* and a side of the second rim water guide channel 23*b*, and may be formed on either one thereof.

Additionally, a retention part similar to the retention part 25 in addition to or in place of the retention part 25 may be provided at the bending site 23*b*1 of the second rim water guide channel 23*b*, although illustration thereof is omitted. Due to a retention part that is provided at the bending site 23*b*1, it is possible to suppress involvement of air at an increased pressure at a time when washing water on the second rim water guide channel 23*b* flows through the bending site 23*b*1 to cause blowing up of air or flow turbulence at a time of water spouting, and hence, it is possible to suppress scattering at a time when water is spouted from the second water spout part 24*b*.

According to an aspect of an embodiment, it is possible to suppress scattering of washing water that is spouted from a water spout part.

According to an aspect of an embodiment as described above, a flush toilet includes a main water guide channel, a bending water guide channel, a rim water guide channel, and a retention part. The main water guide channel causes washing water supplied from a water supply source to flow therethrough. The bending water guide channel bends a flow direction of the washing water supplied from the main water guide channel. The rim water guide channel causes the washing water supplied from the bending water guide channel to flow toward and to be spouted from a water spout part that is opened toward a bowl part. The retention part is formed in at least the bending water guide channel. An upper part of the retention part is formed into an opened concave shape and the retention part retains a part of the washing water supplied from the main water guide channel. Furthermore, the retention part is formed in such a manner that an upper end thereof on a downstream side is horizontal to a bottom surface of the water spout part or higher than the bottom surface of the water spout part.

Thereby, impact force of washing water that is supplied from a main water guide channel to a bending water guide channel, at a time of collision thereof, is relieved by washing water that is retained in a retention part, so that it is possible to prevent air from being readily involved. Hence, it is possible to suppress scattering at a time when water is spouted from a water spout part.

Furthermore, it is possible to form an upper end of a retention part so as to be higher than a bottom surface of a water spout part, so that washing water is spouted, for example, obliquely downward from a water spout part, and hence, it is possible to suppress scattering of washing water that is spouted from a water spout part, to an upper or user side.

The rim water guide channel bends a flow direction of the washing water supplied from the bending water guide channel to spout the washing water from the water spout part toward a back side of the bowl part.

Thus, as a flow direction on a rim water guide channel is changed, water is spouted without controlling air inclusion or flow turbulence that is caused on a bending water guide channel so that washing water from a water spout part may be scattered, but a retention part is included so that it is possible to supply washing water that comparatively does not involve air and does not readily cause flow turbulence to a rim water guide channel, and hence, it is possible to suppress scattering at a time when water is spouted from a water spout part.

The bending water guide channel bends a flow of the washing water supplied from the main water guide channel toward a plurality of different directions.

Thus, as a flow of washing water through a bending water guide channel is bent toward a plurality of directions, washing water collides with the bending water guide channel to readily involve air, but a retention part is included so that impact force thereof at a time of collision thereof is relived and washing water does not readily involve air. Thereby, it is possible to suppress scattering at a time when water is spouted from a water spout part.

The retention part includes a sloping surface that slopes upward from a bottom surface thereof toward the upper end on the downstream side.

Thereby, washing water that is supplied to a retention part moves upward along a sloping surface and flows out to a rim water guide channel so that it is possible to run washing water smoothly, and hence, it is possible to further prevent flow turbulence after flowing out to a rim water guide channel from being readily caused.

The retention part is formed in such a manner that the upper end on the downstream side is positioned in the rim water guide channel.

Thereby, an upper end of a retention part on a downstream side is incorporated into a rim water guide channel. Accordingly, for washing water that flows into a rim water guide channel from an upper end of a retention part on a downstream side, it is possible to suppress, for example, greatly changing a cross-sectional area of a flow channel to cause flow turbulence, and as a result, it is possible to suppress scattering at a time when water is spouted from a water spout part.

The rim water guide channel is formed in such a manner that an inlet part thereof for the washing water supplied from the bending water guide channel is positioned below a water surface of the washing water retained in the retention part.

Thus, an inlet part of a rim water guide channel is positioned below a water surface of washing water in a retention part to be submerged so that, for example, washing water that flows from a retention part to a rim water guide channel does not readily contact air, and as a result, it is possible to suppress involvement of air efficiently. Furthermore, washing water that flows out from a retention part to a rim water guide channel flows while pushing out, for example, air on a rim water guide channel to a water spout part so that air is not readily involved, and hence, it is possible to further suppress scattering at a time when water is spouted from a water spout part. Furthermore, it is also possible to reliably circulate washing water that is retained in a retention part due to washing water that is supplied from a bending water guide channel.

The main water guide channel is formed in such a manner that a bottom surface thereof slopes downward from art upstream side toward a downstream side.

A flow rate or flow volume of washing water that flows through a main water guide channel tends to decease with water saving in recent years, but a main wave guide channel is formed so as to slope downward so that it is possible to increase a flow rate of washing water that flows through a main wave guide channel. Thereby, a velocity of washing water that is spouted from a water spout part also increases so that it is possible to wash a bowl part efficiently and it is possible to improve a washing performance of a flush toilet. Furthermore, as a velocity of washing water increases, collision thereof with a bending water guide channel may be caused to involve a larger amount of air, but a retention part is included so that impact force provided by collision of washing water is relieved and it is possible to prevent air from being readily involved in washing water. Thereby, it is possible to suppress scattering at a time when water is spouted from a water spout part. That is, it is possible to attain both improvement of a washing performance of a flush toilet and suppression of scattering of washing water.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. A flush toilet, comprising:

a main water guide channel configured to cause washing water supplied from a water supply source to flow through the main water guide channel;

a direction change water guide channel configured to change a flow direction of the washing water supplied from the main water guide channel;

a rim water guide channel configured to cause the washing water supplied from the direction change water guide channel to flow toward and spout from a water spout part, the water spout part being configured with an opening on a side of a bowl part; and a retention part configured in at least the direction change water guide channel, the retention part being configured with a concave shape, the retention part retaining a part of the washing water supplied from the main water guide channel, wherein an upper end of the retention part on a downstream side is horizontal to a bottom surface of the water spout part or higher than the bottom surface of the water spout part.

2. The flush toilet according to claim 1, wherein the rim water guide channel is further configured to change a flow direction of the washing water supplied from the direction change water guide channel to spout the washing water from the water spout part toward a back side of the bowl part.

3. The flush toilet according to claim 1, wherein the direction change water guide channel is further configured to divide a flow of the washing water supplied from the main water guide channel into a plurality of different directions.

4. The flush toilet according to claim 1, wherein the retention part includes a sloping surface that slopes upward from a bottom surface of the retention part toward the upper end on the downstream side.

5. The flush toilet according to claim 1, wherein the upper end of the retention part on the downstream side is positioned in the rim water guide channel.

6. The flush toilet according to claim 1, wherein an inlet part of the rim water guide channel for the washing water supplied from the direction change water guide channel is positioned below a water surface of the washing water retained in the retention part.

7. The flush toilet according to claim 1, wherein a bottom surface of the main water guide channel slopes downward from an upstream side toward a downstream side.

* * * * *